US009157282B2

(12) United States Patent
Mohon et al.

(10) Patent No.: US 9,157,282 B2
(45) Date of Patent: Oct. 13, 2015

(54) ROLLER REAMER COMPOUND WEDGE RETENTION

(71) Applicant: SMITH INTERNATIONAL, INC., Houston, TX (US)

(72) Inventors: Brian Mohon, Spring, TX (US); Michael D. Vercher, Dayton, TX (US); Vishal Saheta, Houston, TX (US); Ken Yik Kan Leung, Sugar Land, TX (US)

(73) Assignee: Smith International, Inc., Houston, TX (US)

( * ) Notice: Subject to any disclaimer, the term of this patent is extended or adjusted under 35 U.S.C. 154(b) by 155 days.

(21) Appl. No.: 13/689,606

(22) Filed: Nov. 29, 2012

(65) Prior Publication Data

US 2013/0133954 A1 May 30, 2013

Related U.S. Application Data

(60) Provisional application No. 61/565,326, filed on Nov. 30, 2011.

(51) Int. Cl.

| | |
|---|---|
| ***E21B 10/30*** | (2006.01) |
| ***E21B 10/28*** | (2006.01) |
| ***E21B 10/25*** | (2006.01) |

(52) U.S. Cl.

CPC ..... *E21B 10/30* (2013.01); *E21B 10/25* (2013.01); *E21B 10/28* (2013.01)

(58) Field of Classification Search

CPC ..... E21B 10/22; E21B 10/25; E21B 10/30
USPC ..... 175/345–348, 371, 406, 325.6
See application file for complete search history.

(56) References Cited

U.S. PATENT DOCUMENTS

| | | | | |
|---|---|---|---|---|
| 2,029,770 A | | 2/1936 | Grant | |
| 2,189,034 A | * | 2/1940 | Harrington | 175/346 |
| 2,189,040 A | * | 2/1940 | Jones | 175/346 |
| 2,695,771 A | * | 11/1954 | Salvatori et al. | 175/346 |
| 2,834,579 A | * | 5/1958 | Emanuel | 175/346 |
| 4,182,425 A | | 1/1980 | Garrett | |
| 4,262,760 A | | 4/1981 | Allison et al. | |
| 4,398,610 A | * | 8/1983 | Bassinger | 175/228 |
| 4,542,797 A | | 9/1985 | Garrett | |
| 4,548,284 A | * | 10/1985 | Shinn et al. | 175/346 |

(Continued)

FOREIGN PATENT DOCUMENTS

| | | |
|---|---|---|
| EP | 0274265 A2 | 7/1988 |
| WO | 9513452 A1 | 5/1995 |

(Continued)

OTHER PUBLICATIONS

International Search Report and Written Opinion of PCT Application No. PCT/US2012/067356 dated Feb. 27, 2013: pp. 1-9.

*Primary Examiner* — Jennifer H Gay
(74) *Attorney, Agent, or Firm* — John Vereb; Kimberly Ballew

(57) ABSTRACT

A roller reamer includes a roller assembly deployed in a corresponding axial recess in a tool body. The roller assembly is retained in the axial recess via compound wedging action provided by at least one retention assembly. The retention assembly includes first and second wedges, the first of which converts a substantially radially directed force to an axially directed force and the second of which converts the axially directed force to a cross-axially directed retention force that retains the roller assembly in the axial recess.

16 Claims, 12 Drawing Sheets

(56) References Cited

U.S. PATENT DOCUMENTS

| | | | | |
|---|---|---|---|---|
| 4,557,339 | A * | 12/1985 | Falknor et al. | 175/325.4 |
| 4,561,508 | A * | 12/1985 | Garrett | 175/347 |
| 4,583,604 | A * | 4/1986 | Greer | 175/346 |
| 5,381,868 | A | 1/1995 | Schock | |
| 6,598,690 | B2 | 7/2003 | Peterson | |
| 7,308,956 | B2 * | 12/2007 | Wenzel et al. | 175/346 |
| 7,530,409 | B2 | 5/2009 | Kennedy et al. | |
| 7,661,489 | B2 | 2/2010 | Fyfe | |
| 7,793,715 | B2 | 9/2010 | Kennedy et al. | |
| 2004/0031624 | A1 * | 2/2004 | Scott et al. | 175/371 |
| 2005/0252694 | A1 | 11/2005 | Kennedy et al. | |
| 2006/0278432 | A1 * | 12/2006 | Wenzel et al. | 175/57 |
| 2007/0141768 | A1 | 6/2007 | Yamazaki et al. | |
| 2007/0151768 | A1 * | 7/2007 | Kennedy | 175/346 |
| 2008/0149396 | A1 | 6/2008 | Fyfe | |
| 2009/0114448 | A1 | 5/2009 | Laird et al. | |
| 2009/0145666 | A1 | 6/2009 | Radford et al. | |
| 2009/0194335 | A1 | 8/2009 | Kennedy et al. | |
| 2011/0100722 | A1 | 5/2011 | Mcmanus | |
| 2013/0133954 | A1 * | 5/2013 | Mohon et al. | 175/345 |

FOREIGN PATENT DOCUMENTS

| | | | |
|---|---|---|---|
| WO | 9629499 | A1 | 9/1996 |
| WO | 2008006146 | | 1/2008 |

* cited by examiner

ROLLER REAMER COMPOUND WEDGE RETENTION

CROSS-REFERENCE TO RELATED APPLICATIONS

The present document is based upon and claims priority to U.S. Provisional Patent Application Ser. No. 61/565,326, filed on Nov. 30, 2011, which is herein incorporated by reference in its entirety.

BACKGROUND

Roller reamers have been used in downhole drilling operations for many decades to improve borehole quality. During drilling operations, the drill bit can be subject to wear causing the dimension of the drilled borehole to vary with time. Vibration of the bottom hole assembly (BHA) can also result in a borehole having many imperfections. Moreover, imperfections (such as ledges) and diameter changes can be introduced as the bore hole traverses a boundary between strata having differing mechanical properties. To improve borehole quality and consistency (e.g., to obtain a borehole having a consistent diameter), one or more roller reamers are commonly deployed in the BHA above the bit.

A conventional roller reamer includes a number of rotational cutting assemblies (e.g., three) deployed about the circumference of a tool body. Each cutting assembly includes a cutting or crushing roller deployed about a shaft (or pin) which is in turn coupled to the tool body. The rollers are configured to rotate about the shaft such that they rotate on the shaft and "roll" about the borehole wall during drilling. Such "rolling" reduces frictional forces between the BHA and the borehole wall which in turn reduces, torque, stick slip, and other vibrational modes. The rollers also include a number of cutting/crushing elements deployed on an outer surface thereof such that they cut (or crush) the local formation. Such cutting is intended to smooth the borehole wall and produce a borehole having a consistent diameter.

As is well known in the art, downhole tools are subject to extreme conditions, including mechanical shock and vibration (particularly radial compressive shock), high temperature and pressure, and exposure to corrosive fluids. These extreme conditions can result in numerous tool failure modes and generally require a robust tool design. For example, a robust sealing mechanism is required to prevent ingress of contaminants into the interior of the roller assembly and to prevent loss of lubricants. Seal failure can cause the roller to seize thereby significantly increasing the frictional forces between the BHA and the borehole wall. Such failures commonly require that the failed tool to be tripped out of the well. Moreover, in underguage holes, excessive radial forces on the roller assembly can cause numerous mechanical failures, for example, including fatigue cracking of the shaft and other internal assembly components. As a result of the aforementioned extreme conditions, it is sometimes desirable to service a roller reamer between drilling operations (or during a routine trip out of the wellbore). Such service may include, for example, replacement of the rotational cutting assemblies. A tool configuration that promotes such serviceability can be advantageous.

SUMMARY

A roller reamer is disclosed for use in downhole roller reaming operations. Disclosed roller reamer embodiments include a roller assembly deployed in a corresponding axial recess in a downhole tool body. The roller assembly includes a cutter shell deployed about and arranged to rotate with respect to a common axis of a bearing pin. The roller assembly is retained in the axial recess via compound wedging action provided by at least one retention assembly. One or more disclosed embodiments utilize first and second retention assemblies located at first and second axially opposed ends of the bearing pin. The retention assembly includes first and second wedges, the first of which converts a substantially radially directed force to an axially directed force and the second of which converts the axially directed force to a cross-axially directed retention force that secures the roller assembly in the axial recess.

The disclosed embodiments may provide one or more various technical advantages. For example, in one or more embodiments, the cross-axial retention force (also referred to as a clamping force) is not orthogonal to certain angled side walls of the axial recess in the tool body. This advantageously reduces the stress (and corresponding strain) imparted to the tool body and therefore tends to improve tool life (e.g., via reducing fatigue and cracking in the tool body). Moreover, the applied radial force, the produced axial force, and the produced cross-axial retention force are substantially fully retained within the retention assembly (e.g., within the retention block and the wedge block) and the tool body such that there is essentially no axially load (force) imparted to the bearing pin. Therefore, the fatigue life of the bearing pin, and thus the roller reamer tool, is improved. Moreover, the retention assembly provides a strong retention force that also improves the retention capability of the cutter assembly.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

For a more complete understanding of the disclosed subject matter, and advantages thereof, reference is now made to the following descriptions taken in conjunction with the accompanying drawings, in which:

FIGS. 5A through 8B depict cross sectional views illustrating one or more exemplary installation procedures for the cutter assembly shown on FIG. 3 in which FIGS. 5A and 5B depict placement of the cutter assembly in the reamer body recess; FIGS. 8A and 8B depict the final installation after a predetermined torque has been applied to the jack bolt.

DETAILED DESCRIPTION

Figure 1:
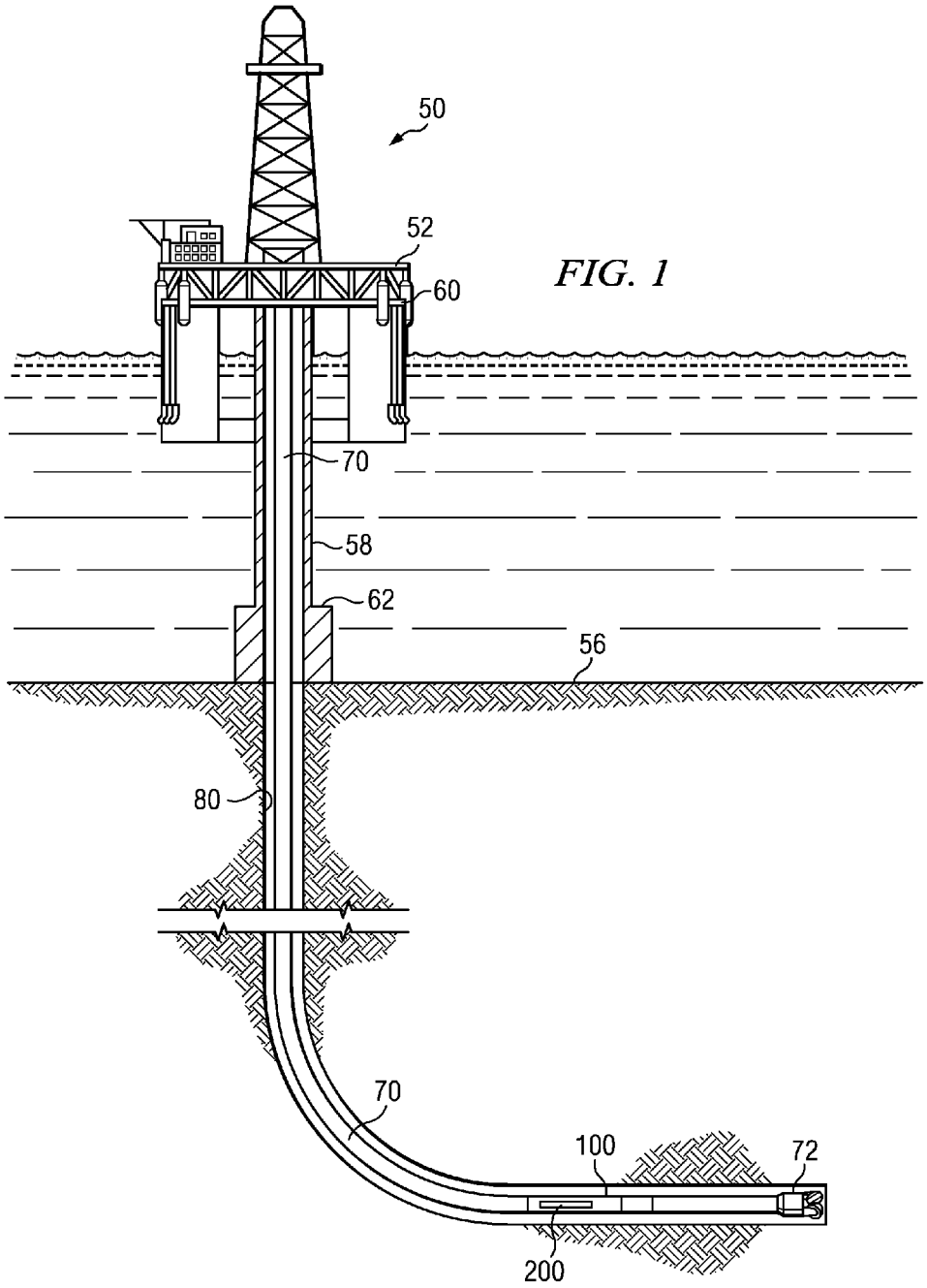
FIG. 1 depicts one example of how a sealed bearing roller reamer embodiment, as disclosed herein, may be utilized in a conventional drilling rig.

Referring to FIGS. 1 through 11, sealed bearing roller reamer embodiments are depicted. With respect to FIGS. 1 through 11, it will be understood that features or aspects of the illustrated embodiments may be shown from various views. Where such features or aspects are common to particular views, they are labeled using the same reference numeral. Thus, a feature or aspect labeled with a particular reference numeral on one view in FIGS. 1 through 11 may be described herein with respect to that reference numeral shown on other views.

FIG. 1 depicts one example of an offshore drilling assembly, generally denoted 50, on which a disclosed embodiment of the roller reamer may be used. A semisubmersible drilling platform 52 is positioned over an oil or gas formation (not shown) disposed below the sea floor 56. A subsea conduit 58 extends from deck 60 of platform 52 to a wellhead installation 62. The platform may include a derrick and a hoisting apparatus for raising and lowering the drill string 70, which, as shown, extends into borehole 80 and includes drill bit 72 and a sealed bearing roller reamer 100 (also referred to as roller reamer 100) with roller assembly 200 deployed above the bit 72. The drill string 70 may optionally further include substantially any number of other downhole tools including, for example, measurement while drilling (MWD) or logging while drilling (LWD) tools, stabilizers, a drilling jar, a rotary steerable tool, and a downhole drilling motor. The sealed bearing roller reamer 100 may be deployed in substantially any location along the string, for example, just above the bit 72 or further uphole above various MWD and LWD tools. Moreover, any given drill string may include a multiple number of the disclosed roller reamers.

It will be understood by those of ordinary skill in the art that the deployment illustrated on FIG. 1 is merely an example. It will be further understood that disclosed embodiments are not limited to use with a semisubmersible platform 52 as illustrated on FIG. 1. The disclosed embodiments are equally well suited for use with any kind of subterranean drilling operation, either offshore or onshore.

Figure 2:
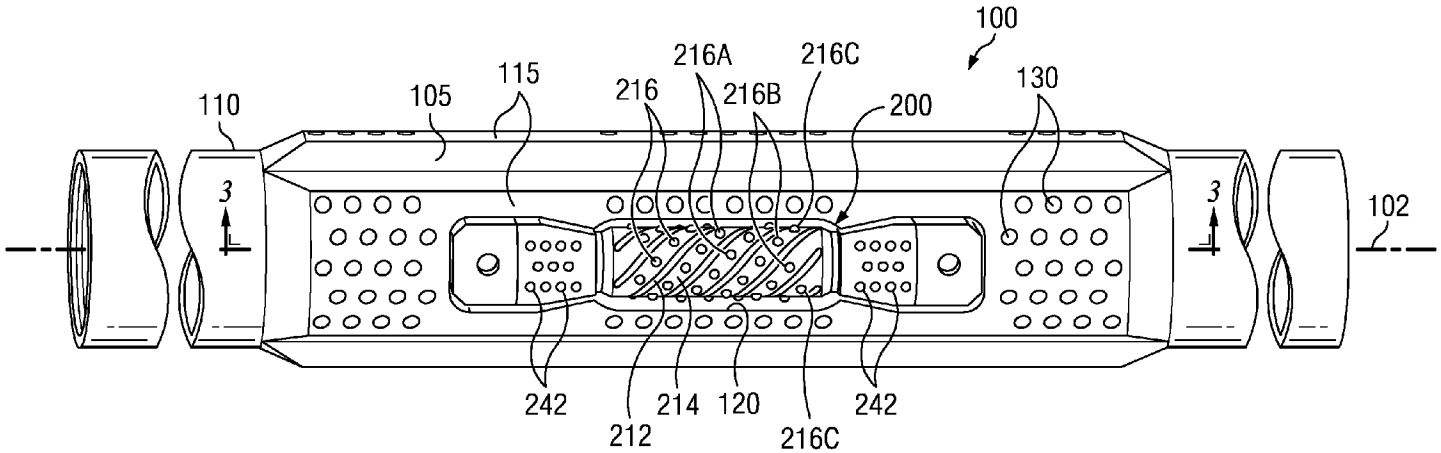
FIG. 2 depicts a perspective view of one example of a sealed bearing roller reamer.

FIG. 2 depicts a perspective view of roller reamer 100. In the depicted embodiment, roller reamer 100 includes a downhole tool body 110 having uphole and downhole threaded ends (not shown) suitable for connecting with a drill string (or other downhole tool string). The tool body is generally cylindrical and includes a plurality of circumferentially spaced fixed blades 115 that extend radially outward from a tool axis 102. Fluid courses 105 (also referred to as flutes) located between the fixed blades 115 allow for the flow of drilling fluid along the exterior surface of the tool 100. Each of the blades 115 includes a roller assembly 200 deployed in a corresponding axial recess 120 of the tool body 110. While sealed bearing roller reamer 100 is shown in FIG. 2 as having a single roller assembly 200, it will be understood that the disclosure is in no way limited to such an embodiment and that the sealed bearing roller reamer commonly includes a plurality of roller assemblies 200 (e.g., three) deployed at substantially equal angular intervals about the tool body 110.

The outer surface of the blades 115 (commonly referred to as the gauge face) may optionally be fitted with conventional wear buttons 130 or the use of other wear protection measures such as hardfacing materials or wear resistant coatings. Those of ordinary skill in the art will readily appreciate that the use of wear buttons and other wear resistant measures is well known in the art and that the disclosed embodiments would not be limited to the use of any particular wear resistant measures.

Figure 3:
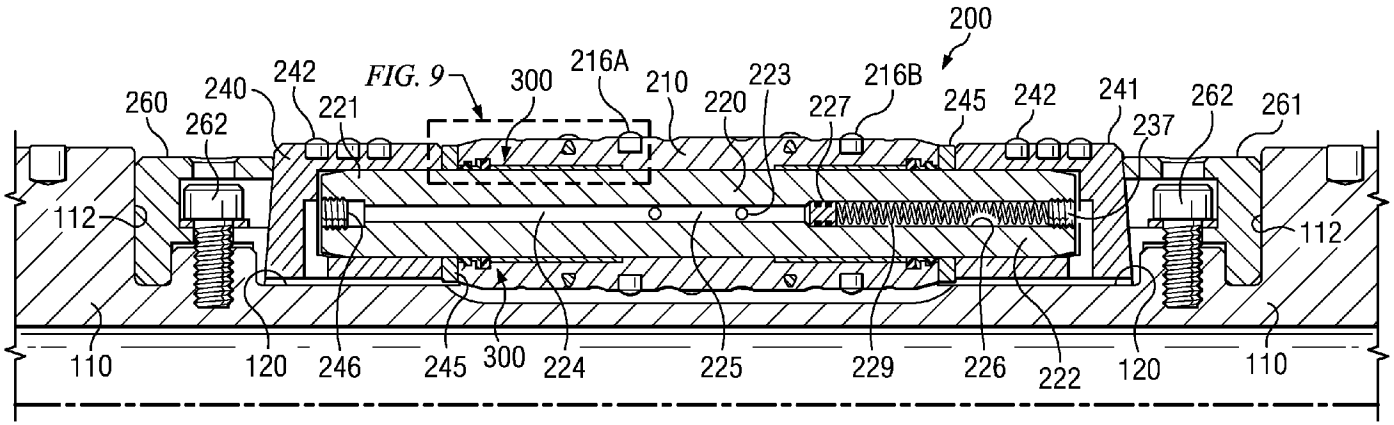
FIG. 3 depicts a detailed cross sectional view of the cutter assembly portion of the sealed bearing roller reamer depicted on FIG. 2.

FIG. 3 depicts a cross sectional view through the roller assembly 200 depicted on FIG. 2. In the depicted example, roller assembly 200 includes a cutter shell or roller shell 210 deployed about a bearing pin 220. As described in more detail below, the cutter shell 210 is disposed to rotate about a central axis of the roller assembly 200 with respect to the bearing pin 220 (i.e., the cutter shell 210 is deployed substantially coaxially about the bearing pin 220 and is arranged and designed to rotate with respect to the bearing pin 220 about the common axis). The first and second axial end portions 221 and 222 of the bearing pin 220 are deployed in and supported by corresponding first and second retention blocks 240, 241. Thrust washers 245 are deployed axially between the cutter shell 210 and the retention blocks 240, 241 thereby enabling the cutter shell 210 to rotate substantially freely with respect to the retention blocks 240, 241. First and second wedge blocks 260, 261 are deployed axially between the corresponding retention blocks 240, 241 and shoulder portions of the reamer body 110 (these shoulder portions are also referred to below as end walls 122). Threadable engagement of jack bolts 262 to the reamer body 110 urges the wedge blocks 260, 261 radially inward and between the retention blocks 240, 241 and the reamer body 110 causing a wedging action that secures the roller assembly 200 in the axial recess 120. This wedging action is described in more detail below with respect to FIGS. 4A-8B.

In the depicted example shown in FIG. 3, bearing pin 220 includes a central chamber 225. A pressure compensation piston 227 divides the central chamber 225 into first and second, grease and spring chambers 224 and 226. Grease may be injected into the grease chamber 224 via one or more ports in plug 246 thereby urging pressure compensation piston 227 against the bias of spring 229 (and into the spring chamber 226). The spring chamber 226 is in fluid communication with the borehole annulus via hollow set screw 237 such that the pressure compensating piston 227 is urged towards the grease chamber 224 via both spring bias and the hydrostatic pressure of the drilling fluid. The grease in the grease chamber 224 is therefore maintained at a pressure greater than or equal to hydrostatic pressure. Radial ports 223 in the bearing pin 220 communicate grease from the grease chamber 224 to an annular region between an inner surface of the cutter shell 210 and an outer surface of the bearing pin 220. As those of ordinary skill in the art will readily appreciate, the grease is intended to maintain lubricity between the cutter shell 210 and the bearing pin 220, thereby promoting substantially frictionless rotation of the cutter shell 210 during drilling.

With reference again to FIG. 2, the disclosed cutter shell 210 includes a plurality of helical flutes 212 and intervening ribs 214. The helical flutes 212 are sized and shaped to enable drilling fluid to transport cuttings and other debris away from the cutting interface (which is also referred to as the crushing interface in roller reamer operations). The ribs 214 include a plurality of cutting elements 216 deployed thereon. The cutting elements 216 are preferably fabricated from a hard material such as tungsten carbide and are configured to crush the formation as the cutter shell 210 rolls over the borehole wall. Any other cutting elements suitable for drilling and reaming operations may be utilized including, for example, polycrystalline diamond cutter (PDC) inserts, thermally stabilized polycrystalline (TSP) inserts, diamond inserts, boron nitride inserts, abrasive materials, and the like. The cutting elements 216 may also have substantially any suitable shape including, for example, flat, spherical, or pointed. The ribs 214 may further include various wear protection measures deployed thereon including, for example, the use of wear buttons, hard-facing materials or various other wear resistant coatings to promote long service life.

The cutting elements 216 are arranged to extend radially outward from the ribs 214 any distance suitable for roller reaming operations. Moreover, each of the cutting elements does not necessarily extend the same distance. In the disclosed embodiment, a first group of the cutting elements 216A, referred to as the gauge elements, extends furthest outward. A second group, referred to as under-gauge one elements 216B, is recessed slightly with respect to the gauge elements. A third group, referred to as under-gauge two elements 216C, is recessed slightly with respect to the under-gauge one elements. In the disclosed embodiment, the retention blocks 240, 241 further include cutting elements 242 deployed in an outer surface thereof. The cutting elements 242, referred to as under-gauge three elements, extend radially outward from the outer surface of the tool body 110 and are recessed slightly with respect to the under-gauge two elements 216C. Cutting elements 242 may be fabricated from the same types of materials (e.g., tungsten carbide) as previously disclosed with respect to cutting elements 216.

Figure 4A:
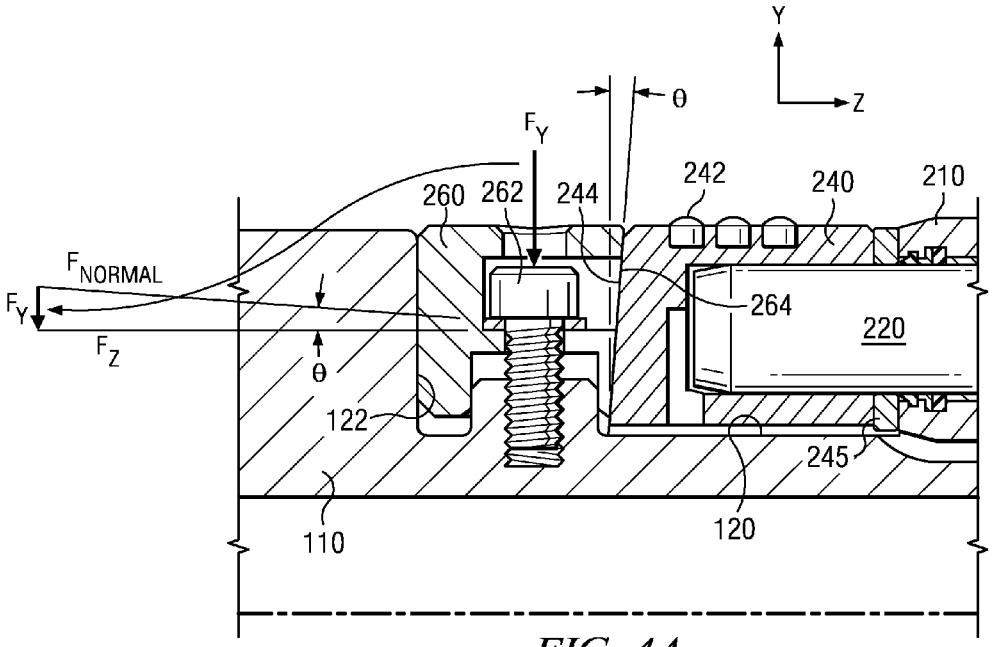
FIG. 4A depicts a cross sectional view of a portion of wedge and retention block portions of the cutter assembly shown on FIG. 3.

FIG. 4A depicts a cross sectional view through one of the wedge blocks 260 and one of the retention blocks 240. In the disclosed embodiment, retention block 240 includes a back angled axial face 244 opposing the bearing pin 220 (i.e., facing wedge block 260). As used here, back angled means that the face is not purely axial, but rather tilted away from axial by a non-zero angle θ (as indicated on FIG. 4A). Wedge block 260 includes a corresponding forward angled axial face 264 facing towards the bearing pin 220 (i.e., facing retention block 240). Engagement of forward angled face 264 with back angled face 244 causes the retention block 240 to translate in the axial direction towards bearing pin 220 as the wedge block 260 is deployed between the retention block 240 and the end wall 122 (FIG. 6A) of recess 120 (e.g., via engagement of the jack bolt 262 with the tool body 110). In preferred embodiments, the angle θ is in a range from about 2 degrees to about 6 degrees. In the depicted embodiment, the angle θ is about four degrees.

It will be understood that the wedging action produced via the engagement of the back angled face 244 and forward angled face 264 produces a mechanical advantage. As shown in FIG. 4A, the radial force $F_y$ applied to the wedge block 260 via the jack bolt 262 produces an amplified axial force $F_z$. This may be expressed mathematically, for example as follows: $F_z=F_y/\tan\theta$. When the angle θ is approximately four degrees, the mechanical advantage is approximately equal to 14, i.e., the magnitude of the produced axial force $F_z$ is about 14 times greater than the magnitude of the applied radial force $F_y$. When the angle θ is in the range from about 2 degrees to about 6 degrees, the mechanical advantage is in the range from about 10 to about 30.

Figure 4B:
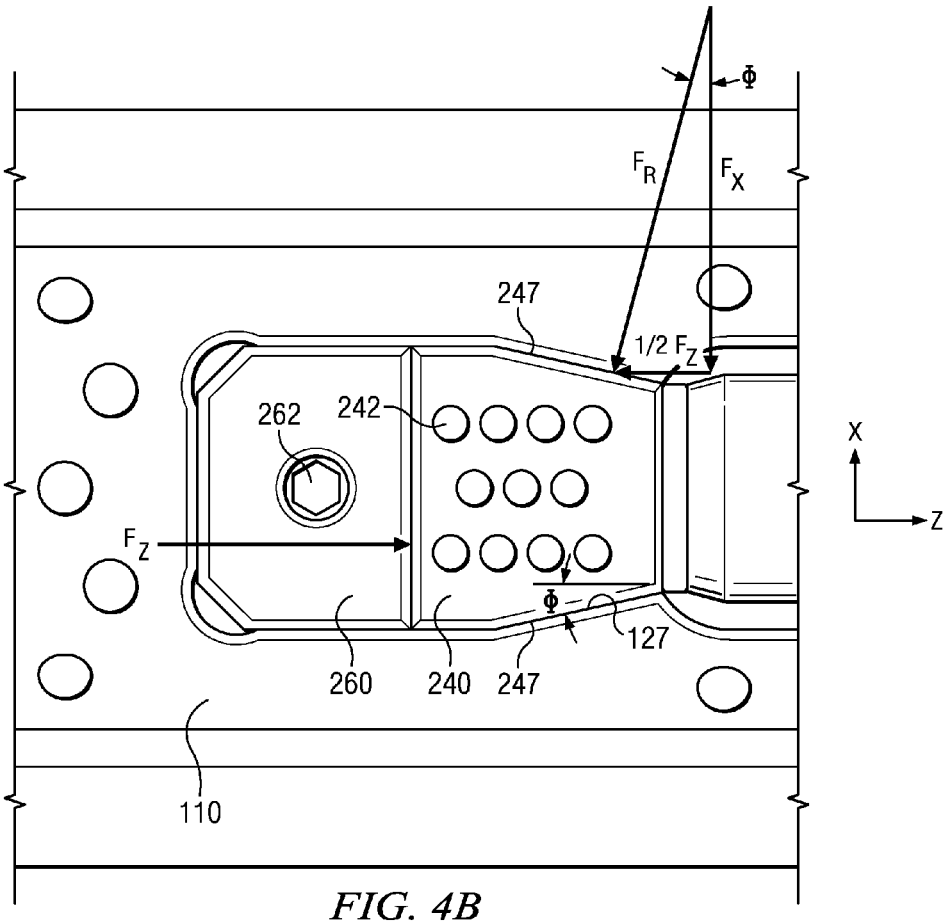
FIG. 4B depicts a side view of the wedge and retention block portions of the cutter assembly shown on FIG. 4A.

FIG. 4B depicts a side (i.e., perspective) view of the wedge 260 and retention 240 blocks depicted on FIG. 4A. As shown, retention block 240 includes at least one angled flank face 247 (e.g., two symmetric flanks 247 are shown in FIG. 4B). As used here, angled means that the flank 247 does not face a purely cross-axial (i.e., circumferential or tangential) direction, but is tilted away from the cross-axial direction by a non-zero angle Φ (as shown). Recess 120 (FIG. 4A) in tool body 110 includes or is defined by a corresponding angled side wall (or interior face) 127. Engagement of the flank 247 with face 127 via application of an axial force to the wedge 240 results in a cross axial retention force that acts to secure the roller assembly 200 in the recess 120. In one or more disclosed embodiments, the angle Φ is in the range from about 10 degrees to about 30 degrees. In the depicted embodiment, the angle Φ is intended to be about 12 degrees.

The wedging action produced via the engagement of flank 247 and face 127 produces a mechanical advantage. As shown in FIG. 4B, the axial force $F_z$ generated by threadably engaging jack bolt 262 to the tool body 110 produces an amplified cross-axial clamping force $F_x$. This may be expressed mathematically, for example, as $F_x=F_z/\tan\phi$. When the angle Φ is approximately equal to 12 degrees, the mechanical advantage is about equal to 5, i.e., the magnitude of the produced cross-axial clamping force $F_x$ is about 5 times greater than the magnitude of axial force $F_z$. When the angle Φ is in the range from about 10 degrees to about 30 degrees, the mechanical advantage is within the range from about 2 to about 6.

With continued reference to FIGS. 4A and 4B, wedge block 260 and retention block 240 provide a compound (dual) wedging action. The radial force $F_y$ applied to the wedge block 260 via jack bolt 262 produces the amplified axial force $F_z$ which in turn produces the amplified cross-axial clamping force $F_x$. This may be expressed mathematically, for example as follows: $F_x=F_y/(\tan\theta\tan\phi)$. When the angle θ is equal to approximately 4 degrees and the angle ϕ is equal to approximately 12 degrees, the mechanical advantage is equal to about 70, i.e., the magnitude of the produced cross-axial clamping force $F_x$ is about 70 times greater than the magnitude of applied radial force $F_y$.

The cross-axial clamping force $F_x$ is not orthogonal to the angled side walls 127 of the tool body recess 120. Thus, this advantageously reduces the stress (and corresponding strain) imparted to the tool body 110 and therefore tends to improve tool life. Moreover, the applied radial force $F_y$, the axial force $F_z$, and the cross-axial clamping force $F_x$ are retained within the retention block 240, the wedge block 260, and the tool body 110 such that there is essentially little or no axially load (force) imparted to the bearing pin 220. This also advantageously improves the fatigue life of the bearing pin 220.

Figure 5A:
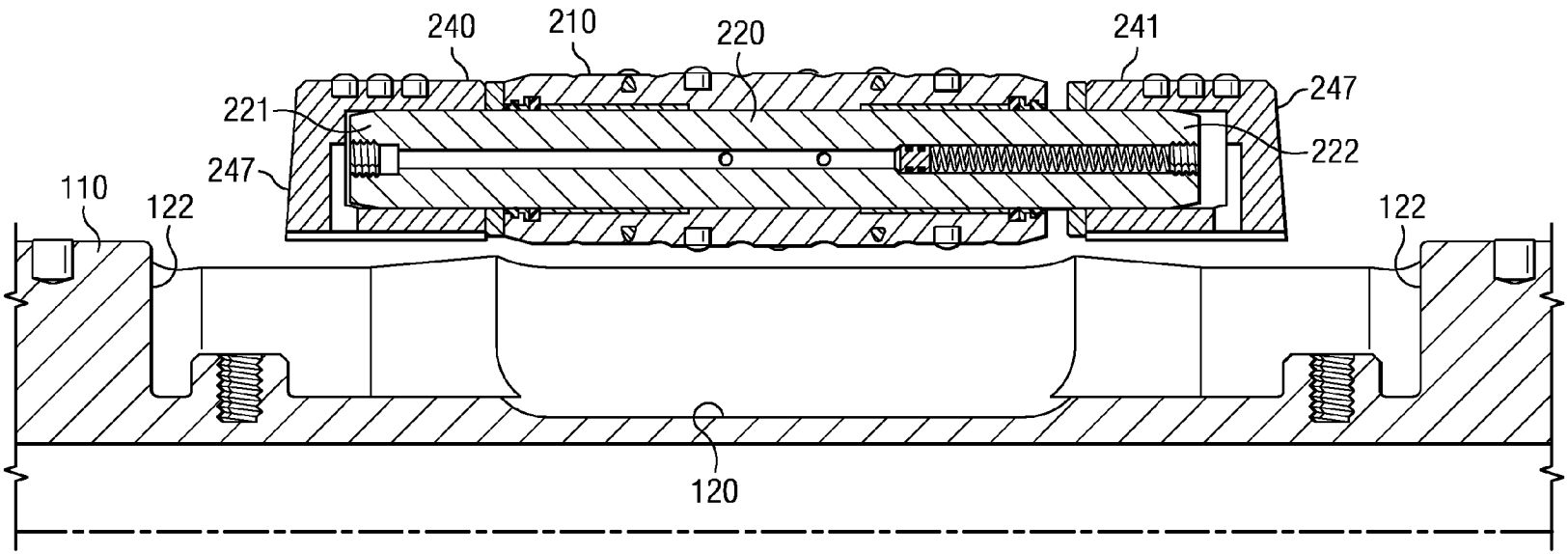
Figure 5B:
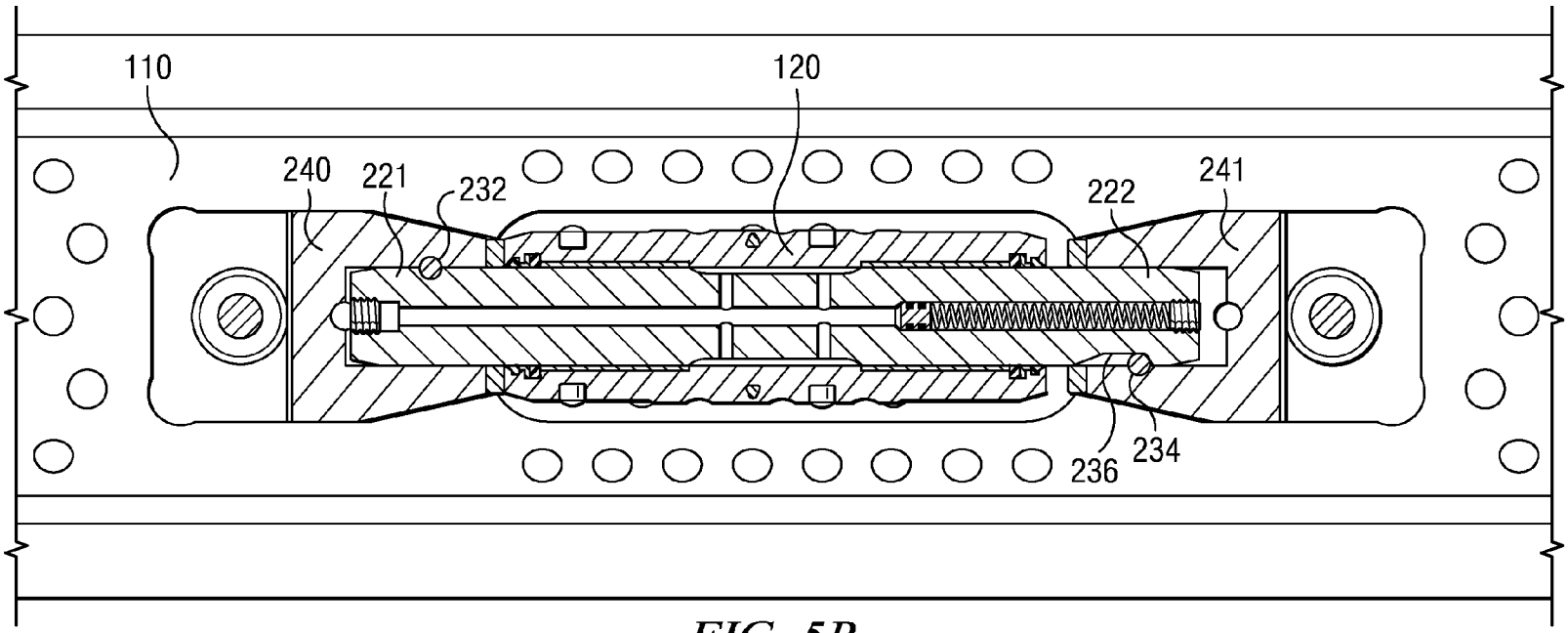

FIGS. 5A through 8B illustrate cross sectional views illustrating one or more exemplary installation procedures for the cutter assembly shown on FIG. 3. FIGS. 5A and 5B illustrate cross sectional side and top views, respectively, of the roller assembly 200 (FIG. 3) being placed in the tool body recess 120. Opposing first and second longitudinal end portions 221 and 222 of the bearing pin 220 are deployed in corresponding first and second retention blocks 240 and 241. In the depicted embodiment, the first end portion 221 of bearing pin 220 is axially and rotationally fixed to the first retention block 240, for example, via side bolt 232. The second end portion 222 of the bearing pin 220 is connected to retention block 241 via at least one pin 234 engaging a corresponding elongated slot 236 in the bearing pin 220. Engagement of the pin 234 with the slot 236 rotationally fixes the bearing pin 220 to the retention block 241 (such that they remain rotationally stationary with respect to the tool body 110) while allowing the retention block 241 to reciprocate axially with respect to the bearing pin 220.

Figure 6A:
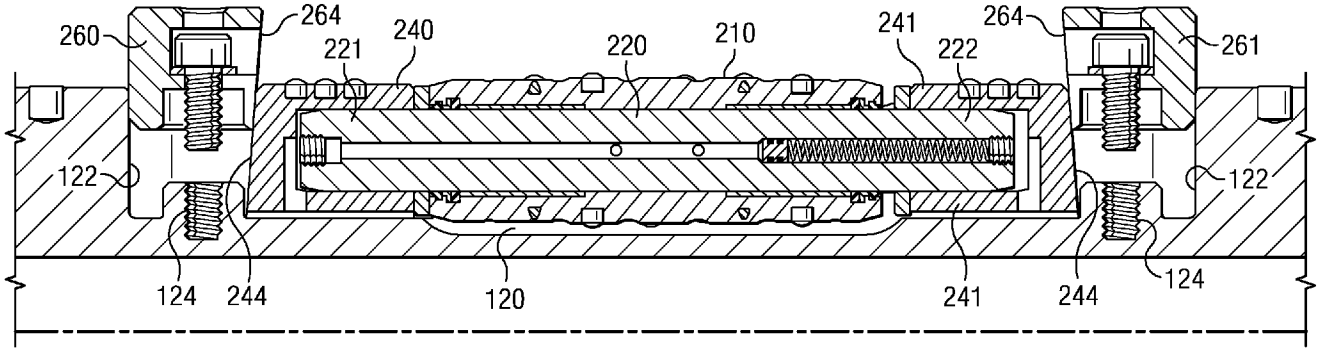
FIGS. 6A and 6B depict placement of the wedge blocks behind the retention blocks in the reamer body recess.
Figure 6B:
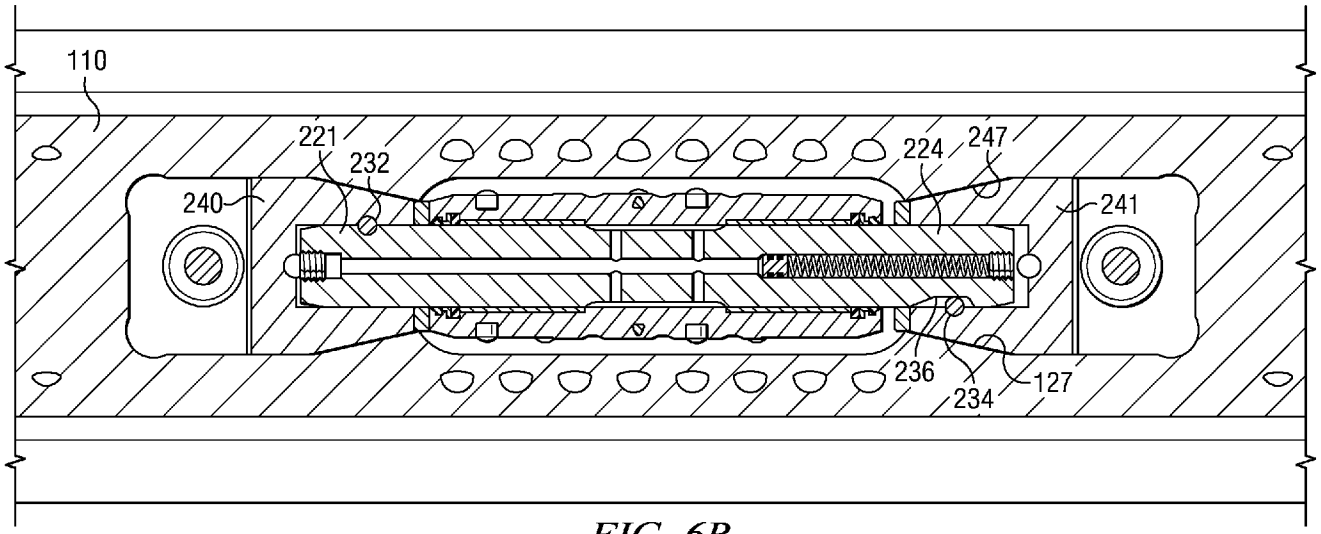
Figure 7A:
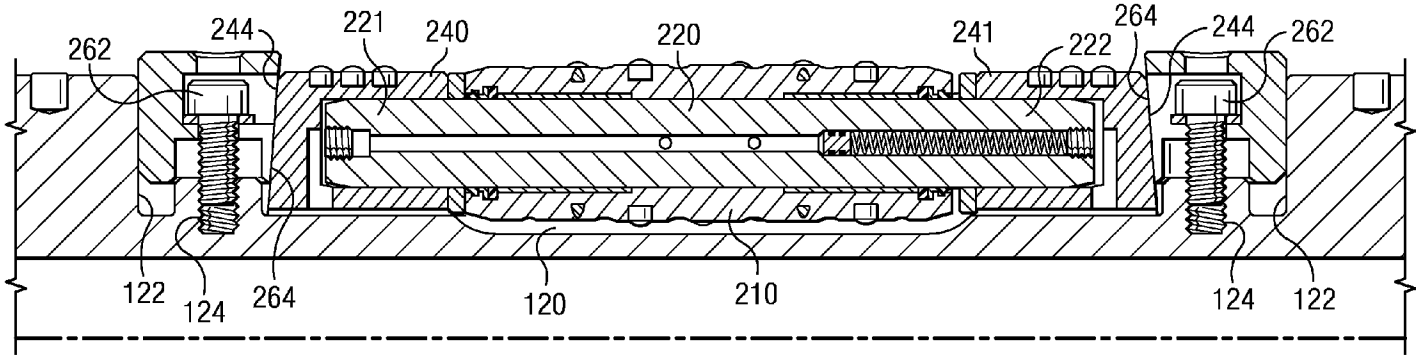
FIGS. 7A and 7B depict engagement of the jack bolt threads with the reamer body.
Figure 7B:
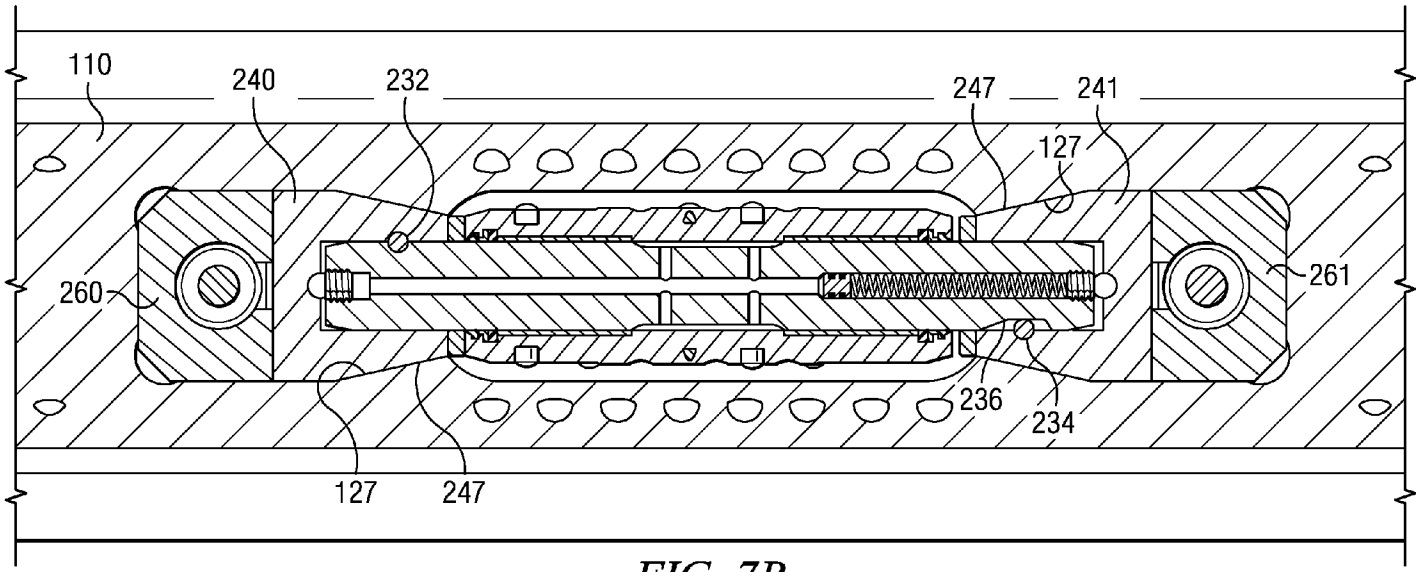

FIGS. 6A and 6B illustrate cross sectional side and top views, respectively, of the wedge block 260, 261 deployments behind or adjacent the retention blocks 240, 241 in the reamer body recess 120. The wedge blocks 260, 261 are deployed behind the corresponding retention blocks 240 and 241 such that the forward angled axial faces 264 of wedge blocks 260, 261 engage the back angled axial faces 244 of retention blocks 240, 241, thereby urging the retention blocks 240 and 241 axially towards one other. The wedges 260, 261 are urged radially inward until the jack bolts 262 engage corresponding threads 124 formed at the base of the recess 120 as depicted in FIGS. 7A and 7B. The wedge blocks 260, 261, retention blocks 240, 241, and the tool body recess 120 are sized and shaped such that a clearance space exists between flanks 247 and faces 127 until the jack bolts 262 begin to threadably engage the tool body 110 (i.e., the threads 124). Flanks 247 contact the faces 127 when the jack bolts 262 engage the tool body 110.

Figure 8A:
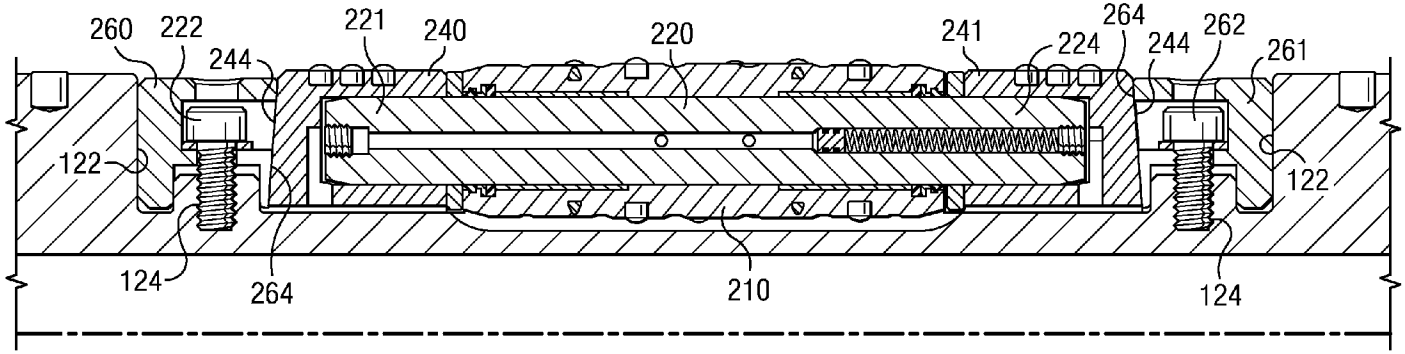
Figure 8B:
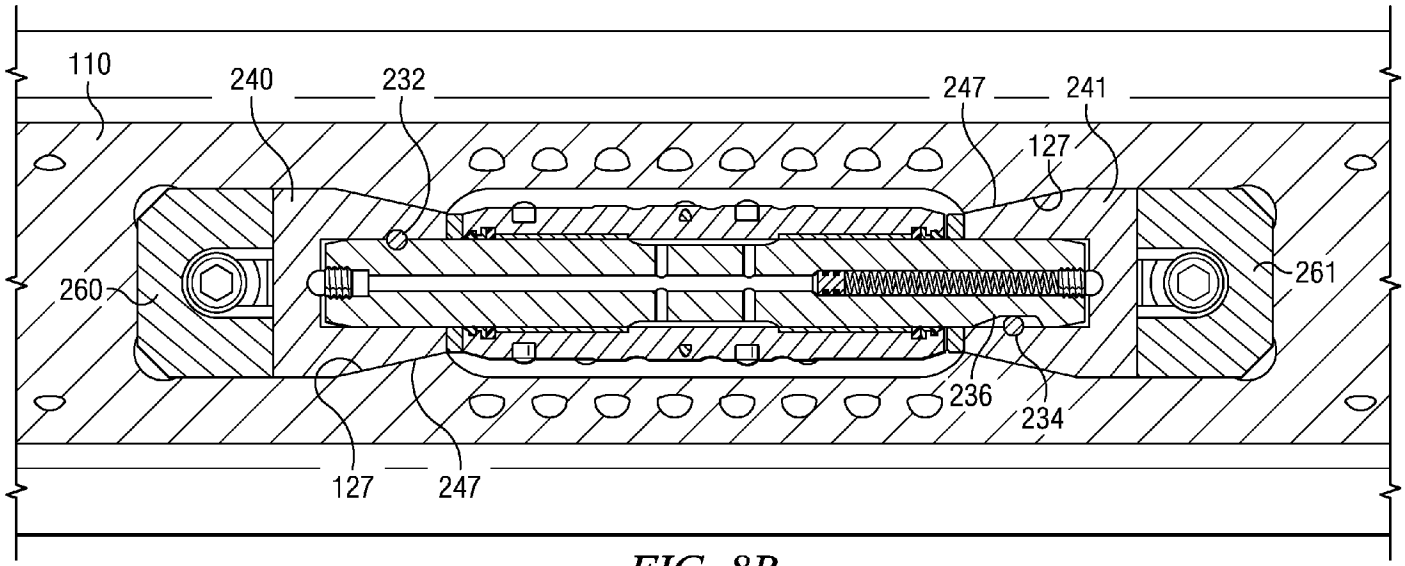

FIGS. 8A and 8B illustrate cross sectional side and top views, respectively, of the final installment of the wedge blocks 260, 261, retention blocks 240, 241, and roller assembly 200 in the tool body recess 120. A force of about 150 foot-pounds is applied to each of the jack bolts 262 to draw the wedge blocks 260, 261 towards the bottom of the recess 120. Such energy, applied to the jack bolts, generates an interference fit between flank 247 and face 127, thereby providing a sufficiently large cross-axial retention force to secure the roller assembly 200 in the recess 120.

Figure 9:
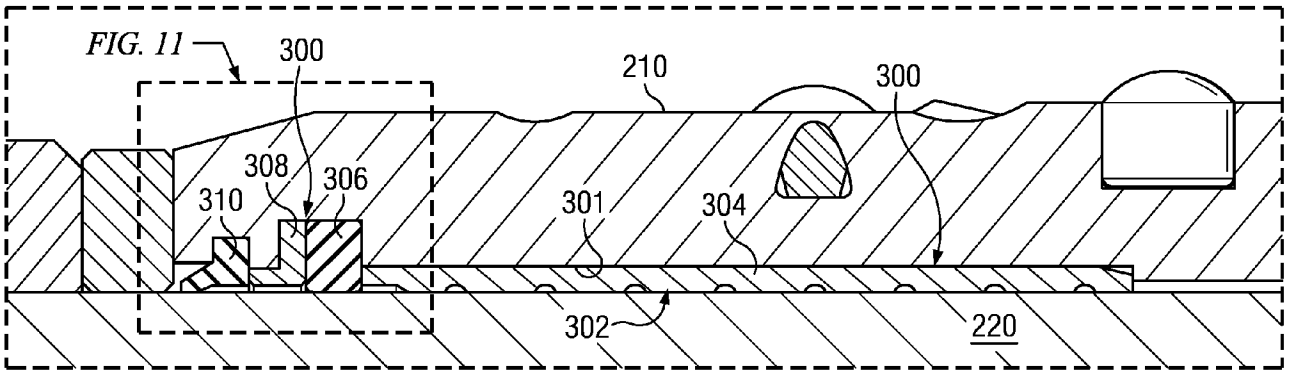
FIG. 9 depicts a cross sectional view of the sealing assembly shown on FIG. 3.

FIG. 9 is a detailed cross sectional view of one of the two sealing assemblies 300 shown on the detail of FIG. 3. As illustrated in FIG. 3, the cutter shell 210 includes an enlarged counter bore 302 (FIG. 9) on each axial end portion thereof. This enlarged counter bore (i.e., bounded by the inner diameter of the cutter shell 210) defines the outer diameter of what is commonly referred to in the art as a "gland" or an "interior gland" between the cutter shell 210 and the bearing pin 220. The gland 302 is configured to house multiple sealing and bushing components and therefore commonly includes several diameter changes. Referring again to FIG. 9, an integral (i.e., non-broken) bearing sleeve 304 (also referred to as a bushing) is deployed in an inmost portion of the gland 302. At least one elastomeric primary seal 306 is deployed adjacent to the bushing 304. An L-shaped backup ring 308 is deployed on the opposing side of the seal 306. In the disclosed embodiment, the backup ring 308 includes a split ring fabricated from a polyether ether ketone (PEEK) material. An excluder 310 (also referred to as a wiper) is deployed at an outermost portion of the gland 302. While FIG. 9 depicts a sealing assembly 300 having a single bushing 304, a single primary seal 306, a single back-up ring 308, and a single exclude 310, it will be understood by those of ordinary skill in the art that the sealing assembly is not so limited. Thus, the sealing assembly 300 may optionally include a plurality of any one or more of elements 304, 306, 308 and 310. Alternatively, sealing assembly 300 may be comprised of one or more other sealing elements known to those of ordinary skill in the art.

Figure 10A:
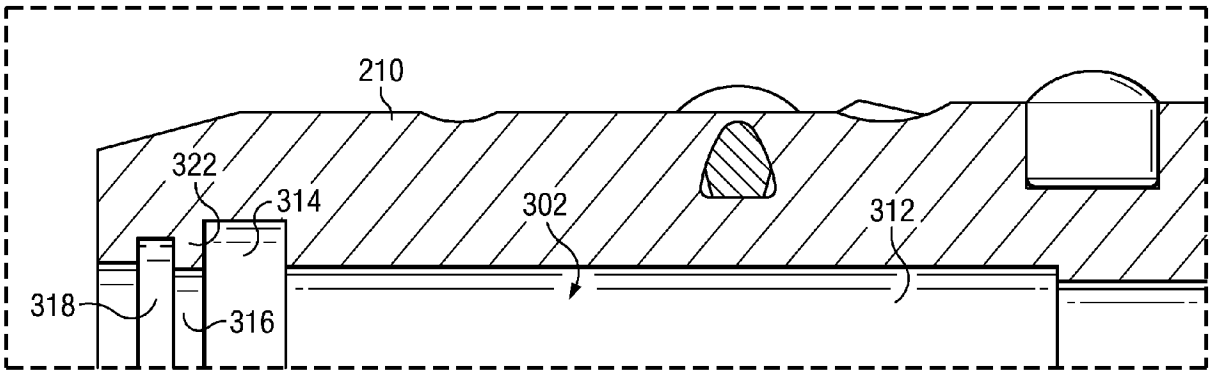
FIGS. 10A through 10E (collectively FIG. 10) depict cross sectional views of one example of an installation procedure for the sealing assembly shown on FIG. 9.
Figure 10B:
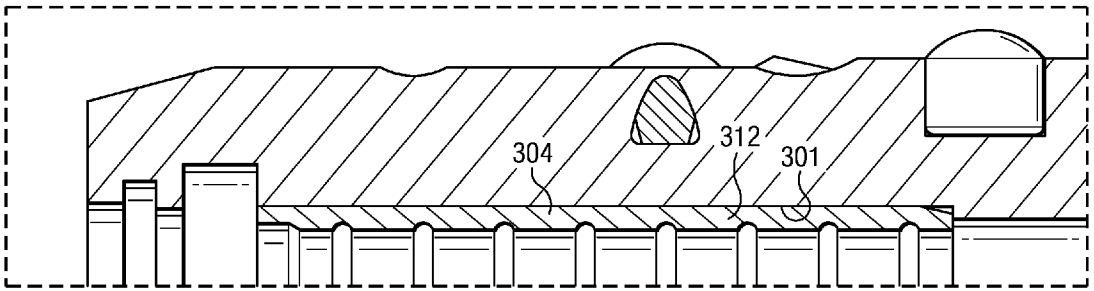
Figure 10C:
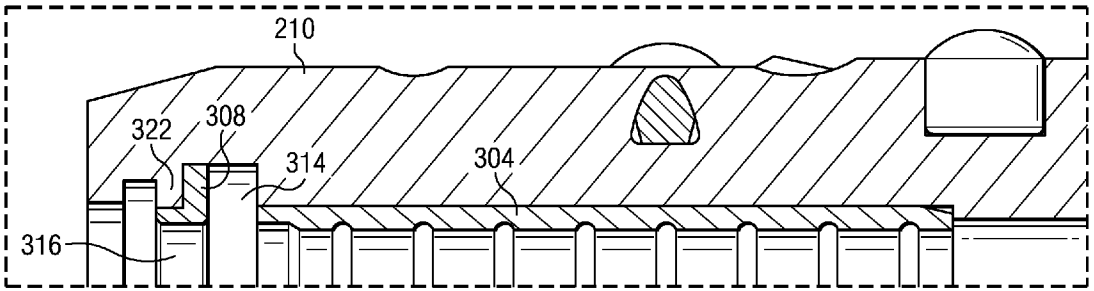
Figure 10D:
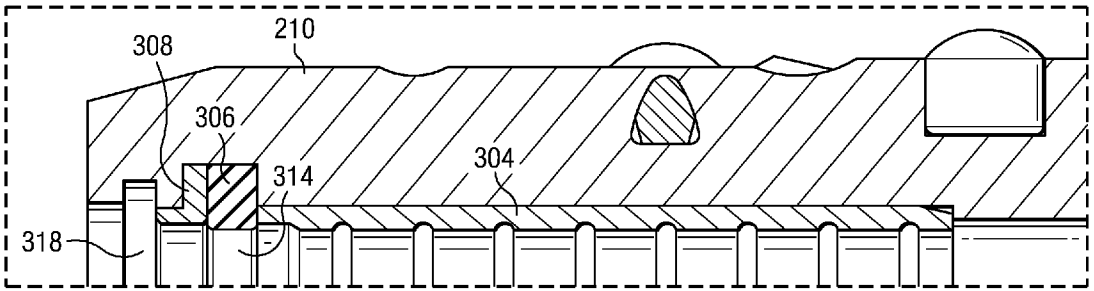
Figure 10E:
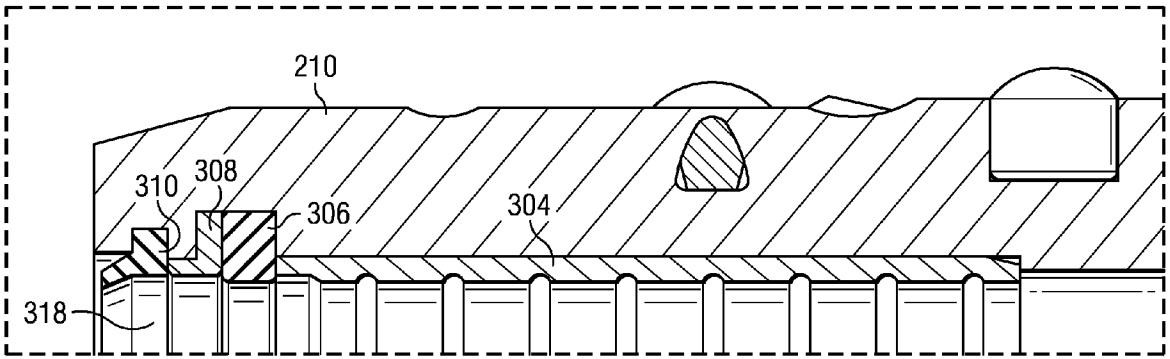

FIGS. 10A through 10E (collectively FIG. 10) depict cross sectional views of one example of an installation procedure for the sealing assembly 300 shown on FIG. 9. FIG. 10A depicts an empty gland 302 prior to installation of any sealing or bushing components. The exemplary gland 302 depicted includes a bushing gland 312, a primary seal gland 314, a backup ring gland 316, and an excluder gland 318, each having a distinct diameter. The primary seal gland 314 and the backup ring gland 316 form shoulder 322. An integral bushing 304 is first press fit into the bushing gland 312 as indicated on FIG. 10B. Being pressed into place in the bushing gland 312, the bushing 304 contacts the inner wall 301 of the cutter shell 110 as shown. The L-shaped backup ring 308 is then pressed into the primary seal gland 314 and the backup ring gland 316 so that it engages shoulder 322 as indicated on FIG. 10C. Being pressed into place, the backup ring 308 also contacts the inner wall 301 of the cutter shell 110 as shown. The primary seal 306 is then disposed in the remaining space in the primary seal gland 314 between the backup ring 308 and the bushing 304 as shown on FIG. 10D. The excluder 310 may then be disposed in the excluder gland 318 (at the outermost portion of gland 302) as shown on FIG. 10E. This procedure may then be repeated to make up the sealing assembly on the opposing axial side of the cutter shell 210 (see FIG. 3).

Figure 11:
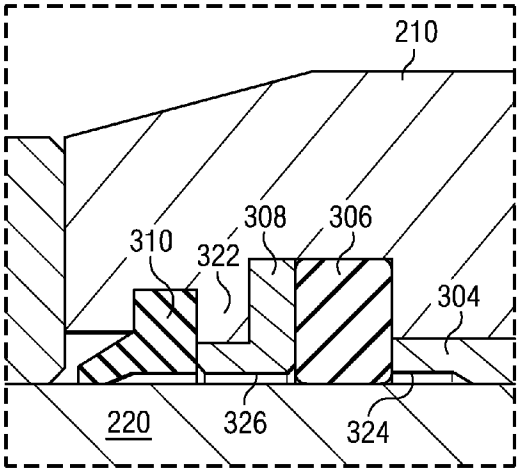
FIG. 11 depicts a cross sectional view of the sealing assembly shown on FIG. 9.

The bearing pin 220 may be inserted into the cutter shell 210 after each of the sealing and bushing components have been deployed in the gland 302. FIG. 11 depicts a detailed view of the fully assembled sealing assembly configuration shown on FIG. 9. In the disclosed example, the bushing 304 includes a counter bore 324 on a longitudinal end portion adjacent to the primary seal 306. The counter bore 324 is intended to create an extrusion gap between the bushing 304 and the bearing pin 220 in order to separate the sealing and bearing functions of the assembly 300. The backup ring 308 is sized and shaped so as to form a similarly sized extrusion gap 326 on its side adjacent to the bearing pin 220. Engagement of the L-shaped backup ring 308 with the shoulder 322 between glands 314 and 316 ensures formation of a properly sized extrusion gap 326. The radial dimension of the extrusion gaps 324 and 326 is generally selected based on the diameter of the bearing pin 220, but is preferably (although not necessarily) within the range from about 0.005 inches to about 0.015 inches.

The primary seal 306 and the excluder 310 may be fabricated from any elastomeric material suitable for downhole deployment including, for example, nitrile butadiene, carboxylated acrylonitrile butadiene, hydrogenated acrylonitrile butadiene, highly saturated nitrile, carboxylated hydrogenated acrylonitrile butadiene, ethylene propylene, ethylene propylene diene, tetrafluoroethylene and propylene (AFLAS), fluorocarbon and perfluoroelastomer. Other suitable materials, known to those of ordinary skill in the art, may be equally employed.

It may be advantageous in certain of the disclosed embodiments for the primary seal 306 to include a dual dynamic sealing element. Suitable dual dynamic sealing elements are disclosed in commonly assigned U.S. Pat. No. 6,598,690, which is incorporated by reference herein in its entirety. Briefly, dual dynamic sealing elements are typically high aspect ratio seals that include hard elastomeric materials on the inner and outer diameter surfaces and a comparatively softer elastomeric material at the center. Such sealing elements tend to provide improved wear resistance on the outer diameter and inner diameter surfaces in the event of seal rotation in the gland. The softer rubber at the center is generally sufficient to energize the seal and provide adequate sealing function.

Advantages of one or more embodiments of the disclosed roller reamer are now described in further detail by way of the following example. Such example is intended to be an example only and should not be construed as in any way limiting the scope of the claims. Standard pull tests were conducted with and without vibration in order to determine the retention capability of an example roller reamer embodiment, as disclosed herein, versus a control, commercially-available roller reamer in which a retention block is press fit into the tool body recess. The example roller reamer embodiment included a compound wedge providing a mechanical advantage of about 70 in which the angle $\theta$ was equal to approximately 4 degrees and the angle $\Phi$ was equal to approximately 12 degrees.

A test body was prepared including a recess for deployment of the retention assembly (i.e., the wedge and retention blocks in the example and a retention block in the control). The retention assemblies were identical in size and shape to those used in 8.5 inch diameter tools. Tension (force) was applied orthogonal to the test body face such that the load acted to pull the retention assembly directly out of the test body (i.e., equivalent to pulling the retention assembly radially out of a roller reamer tool body). The applied load was increased in 100 pound increments until failure (defined as movement of the retention assembly by ⅛ inch in relation to the test body). For some of the tests, a 500 pound 50 Hz vibration was superimposed on the applied load.

TABLE 1 summarizes the results of these pull tests (with and without vibration). As indicated, the example roller reamer provides a significant increase in retention capability as compared to the control roller reamer. In the pull test without vibration, the failure load increased by about 250% (from about 5100 to about 18,000 pounds-force). In pull tests with vibration, the failure load increased over 450% (from less than about 3000 to more than about 16,000 pounds-force).

TABLE 1

| Test No. | Test Type | Control (lbsf) | Example (lbsf) | Improvement |
|---|---|---|---|---|
| 1 | Vibration | 2900 | 17100 | 490% |
| 2 | Vibration | 2900 | 16200 | 459% |
| 3 | Vibration | 2700 | 17300 | 541% |
| 4 | Pull | 5100 | 18000 | 253% |

Although one or more sealed bearing roller reamer embodiments and their advantages have been disclosed, it should be understood that various changes, substitutions and alternations can be made herein without departing from the spirit and scope of the invention as disclosed herein.

What is claimed is:

1. A roller reamer comprising:

a tool body including an axial recess having an angled interior face, the angled interior face being angled away from a cross-axially facing orientation;

a roller assembly deployed in the axial recess, the roller assembly including a roller shell deployed substantially coaxially about a bearing pin, the roller shell being arranged and designed to rotate with respect to the bearing pin about a common axis;

a retention block supporting an axial end portion of the bearing pin, the retention block including an angled flank arranged and designed to engage the angled interior face of the axial recess such that an axial force on the retention block produces a cross-axial retention force on the angled interior face of the axial recess, the retention block further including a back angled axial face on a side opposing the bearing pin, the back angled axial face being angled away from an axial orientation; and a wedge block deployed between the retention block and an end wall of the axial recess, the wedge block including a forward angled axial face configured to engage the back angled axial face of the retention block such that a cross axial force urging the wedge block into the axial recess produces the axial force on the retention block urging the retention block away from the end wall of the axial recess.

2. The roller reamer of claim 1, wherein the angled flank of the retention block is angled with respect to a longitudinal axis of the roller assembly by about 10 degrees to about 30 degrees.

3. The roller reamer of claim 1, wherein the back angled axial face of the retention block is angled with respect to a radial direction by about 2 degrees to about 6 degrees.

4. The roller reamer of claim 1, wherein:

engagement of the forward angled axial face of the wedge block with the back angled axial face of the retention block generates an axial force that urges the retention block flank into contact with the angled face of the axial recess; and engagement of the retention block flank with the angled face of the axial recess generates a cross-axial force that secures the roller assembly in the axial recess.

5. The roller reamer of claim 1, wherein:

the retention block comprises first and second retention blocks supporting corresponding opposing first and second opposing axial end portions of the bearing pin; and the wedge block comprises first and second wedge blocks deployed between the first and second retention blocks and corresponding first and second opposing end walls of the axial recess.

6. The roller reamer of claim 5, wherein the first retention block is rotationally and axially fixed to the first end portion of the bearing pin.

7. The roller reamer of claim 5, wherein the second retention block is rotationally fixed to and configured to translate axially with respect to the second end portion of the bearing pin.

8. The roller reamer of claim 1, wherein the wedge block is coupled to the tool body.

9. A roller reamer comprising:

a tool body including an axial recess having a plurality of angled interior faces, the angled interior faces being angled away from a cross-axially facing orientation;

a roller assembly deployed in the axial recess, the roller assembly including a roller shell deployed substantially coaxially about a bearing pin, the roller shell being arranged and designed to rotate with respect to the bearing pin about a common axis;

first and second retention blocks supporting corresponding first and second opposing axial end portions of the bearing pin, each of the retention blocks including an angled flank, said angled flank sized and shaped to engage a corresponding one of the plurality of angled interior faces of the axial recess such that an axial force on the retention block produces a cross-axial retention force on the angled interior face of axial recess, each of the retention blocks further including a back angled axial face on a side opposing the bearing pin, the back angled axial faces being angled away from an axial orientation; and a first wedge block deployed between the first retention block and a first end wall of the axial recess and a second wedge block deployed between the second retention block and a second end wall of the axial recess, each of the first and second wedge blocks including a forward angled axial face such that the forward angled axial face of the first wedge block is configured to engage the back angled axial face of the first retention block and the forward angled axial face of the second wedge block is configured to engage the back angled axial face of the second retention block such that a cross axial force urging the wedge block into the axial recess produces the axial force on the retention block urging the retention block away from the end wall of the axial recess.

10. The roller reamer of claim 9, wherein the angled flank of each of the first and second retention blocks is angled with respect to a longitudinal axis of the roller assembly by about 10 degrees to about 30 degrees.

11. The roller reamer of claim 9, wherein the back angled axial face of each of the first and second retention blocks is angled with respect to a radial direction by about 2 degrees to about 6 degrees.

12. The roller reamer of claim 9, wherein:

engagement of the forward angled axial face of the first wedge block with the back angled axial face of the first retention block and engagement of the forward angled axial face of the second wedge block with the back angled axial face of the second retention block generates axial forces that urge the angled flanks of the first and second retention block flanks into contact with the angled interior faces of the axial recess; and engagement of the angled flanks of the first and second retention blocks with the angled interior faces of the axial recess generates cross-axial forces that secure the roller assembly in the axial recess.

13. The roller reamer of claim 9, wherein the first retention block is rotationally and axially fixed to the first end portion of the bearing pin.

14. The roller reamer of claim 9, wherein the second retention block is rotationally fixed to and configured to translate axially with respect to the second end portion of the bearing pin.

15. The roller reamer of claim 9, wherein at least the first or second wedge block is coupled to the tool body.

16. A roller reamer comprising;

a tool body including a plurality of axial recesses;

a roller assembly deployed in each of the plurality of axial recesses, each of the roller assemblies including a roller shell deployed substantially coaxially about a corresponding bearing pin, the roller shell being disposed to rotate with respect to the bearing pin about a common axis, enlarged inner diameters at each axial end portion of the roller shell defining outer diameters of first and second internal glands; and first and second sealing assemblies deployed in the corresponding first and second internal glands radially between the bearing pin and the roller shell of each roller assembly, each of the internal glands including an innermost bushing gland, a primary seal gland axially outward from the bushing gland, a backup ring gland axially outward from the primary seal gland, and an outermost excluder gland, the primary seal gland and the backup ring gland forming an internal shoulder;

each of the sealing assemblies including an integral bearing sleeve disposed in the corresponding bushing gland, a primary seal disposed in the corresponding primary seal gland, an L-shaped backup ring disposed in the backup ring gland such that it engages the shoulder, and an excluder disposed in the excluder gland.

* * * * *